US008002434B2

(12) United States Patent
Sommers et al.

(10) Patent No.: US 8,002,434 B2
(45) Date of Patent: Aug. 23, 2011

(54) LED LIGHTING SYSTEMS FOR PRODUCT DISPLAY CASES

(75) Inventors: Mathew Sommers, Sagamore Hills, OH (US); Mark J. Mayer, Sagamore Hills, OH (US); William David Sekela, Aurora, OH (US); Alan B. Toot, Warren, OH (US); Gerald P. O'Hara, Jr., North Canton, OH (US); Joseph M. Hobbs, Avon, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 66 days.

(21) Appl. No.: 12/029,742

(22) Filed: Feb. 12, 2008

(65) Prior Publication Data

US 2008/0219002 A1 Sep. 11, 2008

Related U.S. Application Data

(60) Provisional application No. 60/889,458, filed on Feb. 12, 2007.

(51) Int. Cl.
*F21V 7/00* (2006.01)

(52) U.S. Cl. ... 362/247; 362/241; 362/243; 362/249.02; 362/297; 362/346; 362/800

(58) Field of Classification Search ..... 362/92, 362/133, 217.05–217.07, 235, 241, 243, 362/247, 249.02, 296.01, 297–298, 341, 362/346–347, 350, 800
See application file for complete search history.

(56) References Cited

U.S. PATENT DOCUMENTS

| | | | |
|---|---|---|---|
| 5,475,241 | A | 12/1995 | Harrah et al. |
| 5,564,819 | A | 10/1996 | Yamaguchi |
| 6,404,131 | B1 | 6/2002 | Kawano et al. |
| 6,995,355 | B2 | 2/2006 | Rains et al. |
| 7,083,313 | B2 * | 8/2006 | Smith ..... 362/555 |

OTHER PUBLICATIONS

International Search Report PCT/US2008/053665 dated Jul. 14, 2008.
Written Opinion of the International Searching Authority (Form PCT/ISA/237) PCT/US2008/053665 dated Jul. 14, 2008.

* cited by examiner

*Primary Examiner* — Jason Moon Han
(74) *Attorney, Agent, or Firm* — Fay Sharpe LLP

(57) ABSTRACT

An LED lamp for use in a display case includes a plurality of LEDs and an optic for redirecting the light to illuminate the contents of the display case.

15 Claims, 11 Drawing Sheets

LED LIGHTING SYSTEMS FOR PRODUCT DISPLAY CASES

This application claims priority to Provisional Application Ser. No. 60/889,458 filed Feb. 12, 2007. This application incorporates by reference U.S. Patent Application Publication No. U.S. 2005/0265019 A1.

BACKGROUND

With reference to FIG. 1, a typical refrigerated display case 10 has a door and frame assembly 12 mounted to a front portion of the case. The door and frame assembly 12 includes side frame members 14 and 16, respectively, and top and bottom frame members 18 and 22, respectively, that interconnect the side frame members. Doors 24 mount to the frame members via hinges 26. The doors include glass panels 28 retained in frames 32. Handles 34 are provided on each door. Mullions 36 mount to the top and bottom frame members 18 and 22 to provide door stops and points of attachment for the doors 24 or the hinges 26. The refrigerated display case 10 can be a free-standing enclosure or a built-in enclosure.

Known LED lighting systems used to illuminate display cases are typically designed to accommodate a certain throw, which is the perpendicular distance between the light source and the target plane, which is the plane that is to be illuminated. Known LED lighting systems also include many LEDs, which can decrease the efficiency of the lighting system.

SUMMARY

An LED lamp that provides a broader range of throw as compared to known lamps includes a plurality of LEDs spaced along an axis of the lamp and at least one optic associated with the LEDs. The at least one optic includes a plurality of domes extending away from a base and each being separated from the base by at least one opening. Each dome includes an inner primary reflective surface associated with a corresponding LED. At least one of the domes is arranged with respect to a respective LED to redirect light reflecting off of the respective primary reflective surface from the respective LED in a first general direction. Also, at least one of the domes is arranged with respect to another respective LED to direct light reflecting off of the respective primary reflective surface from the another respective LED in a second general direction that is opposite the first general direction.

Another embodiment of a lamp, which can be useful in a display case includes a mounting structure, a printed circuit board ("PCB"), a plurality of LEDs mounted on the PCB, and an optic for cooperating with the plurality of LEDs to direct light from the LEDs toward a target plane. The optic includes a snap-in feature to attach the optic to the mounting structure sandwiching the PCB between the optic and the mounting structure.

Another embodiment of an LED lamp for attaching to a mullion in a display case to illuminate contents of the display case includes a plurality of LEDs spaced from a target plane, and at least one optic associated with the LEDs. The at least one optic includes a plurality of primary reflective surfaces and a plurality of secondary reflective surfaces each being associated with a corresponding LED. The primary reflective surfaces are shaped to direct light from the respective LED away from an area of the target plane that is generally perpendicular to the mullion. The secondary surfaces are shaped to direct light from the respective LED toward the area of the target plane that is generally perpendicular to the mullion.

DETAILED DESCRIPTION

Figure 2:
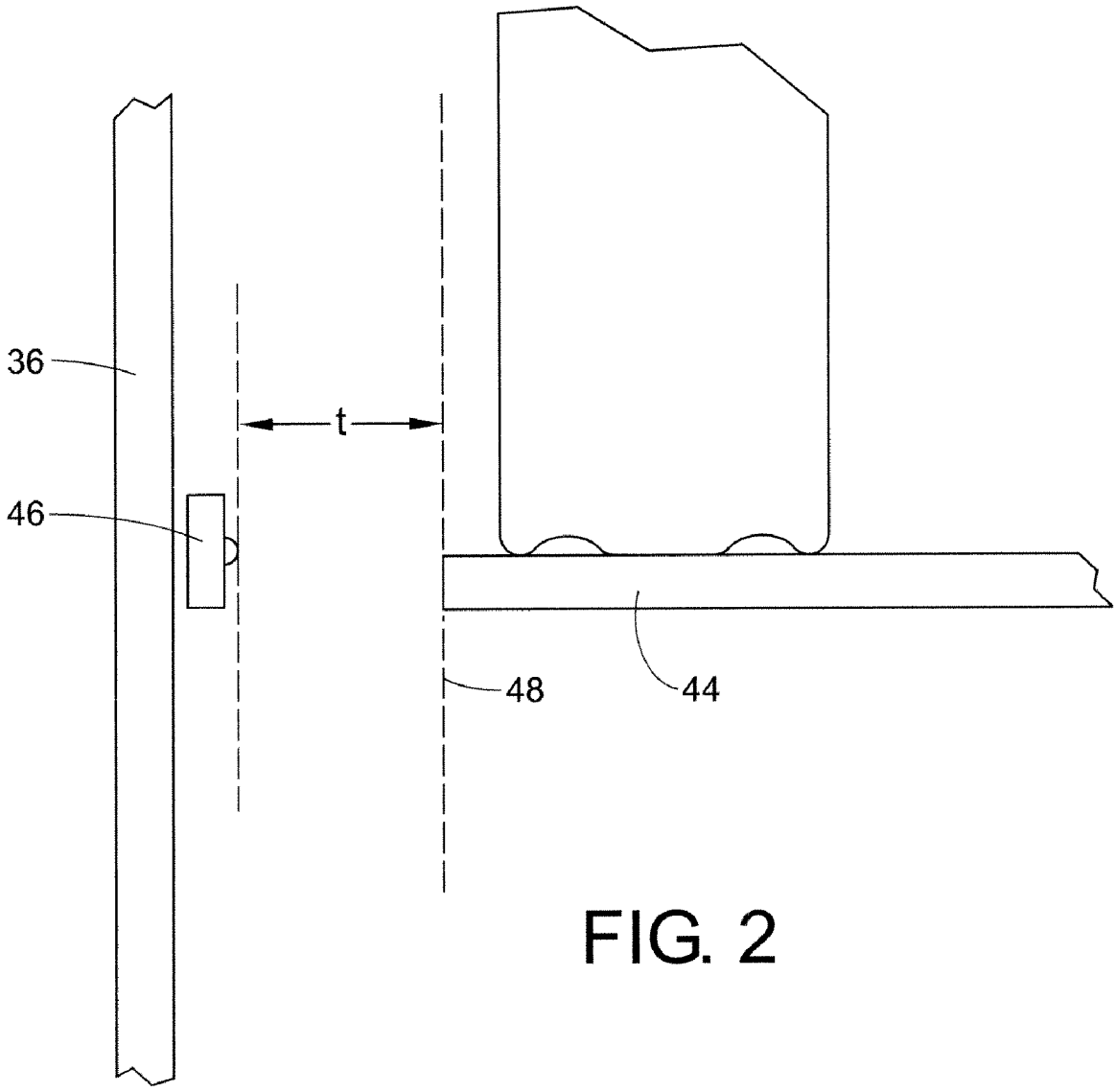
FIG. 2 is a schematic view of a cross-section taken along line 2-2 in FIG. 1.

The lighting assembly, which may also be referred to as a lamp assembly or an LED assembly, described below is useful in that it provides a broader range of throw as compared to known lighting assemblies. For example, with reference to FIG. 2, a light source 46, which can include an LED, is displaced from a target plane 48 a distance t. This distance t is referred to as the throw. Depending upon the environment in which the commercial refrigerator (or other display case) is disposed, for example, whether it is disposed in a convenience store or in a grocery store, the distance that the front of the shelf 44 is offset from the mullion 36 determines the distance of throw for the light source. In FIG. 2, the light source 46 is depicted as being offset a certain distance from the mullion 36, and it is this distance that accommodates for the heat sink and electronic devices that are used drive the light source. The lighting assembly as disclosed herein also uses less energy then known lighting assemblies and can also use many different LED devices from many different manufacturers, thus increasing the versatility of the assembly.

Figure 3:
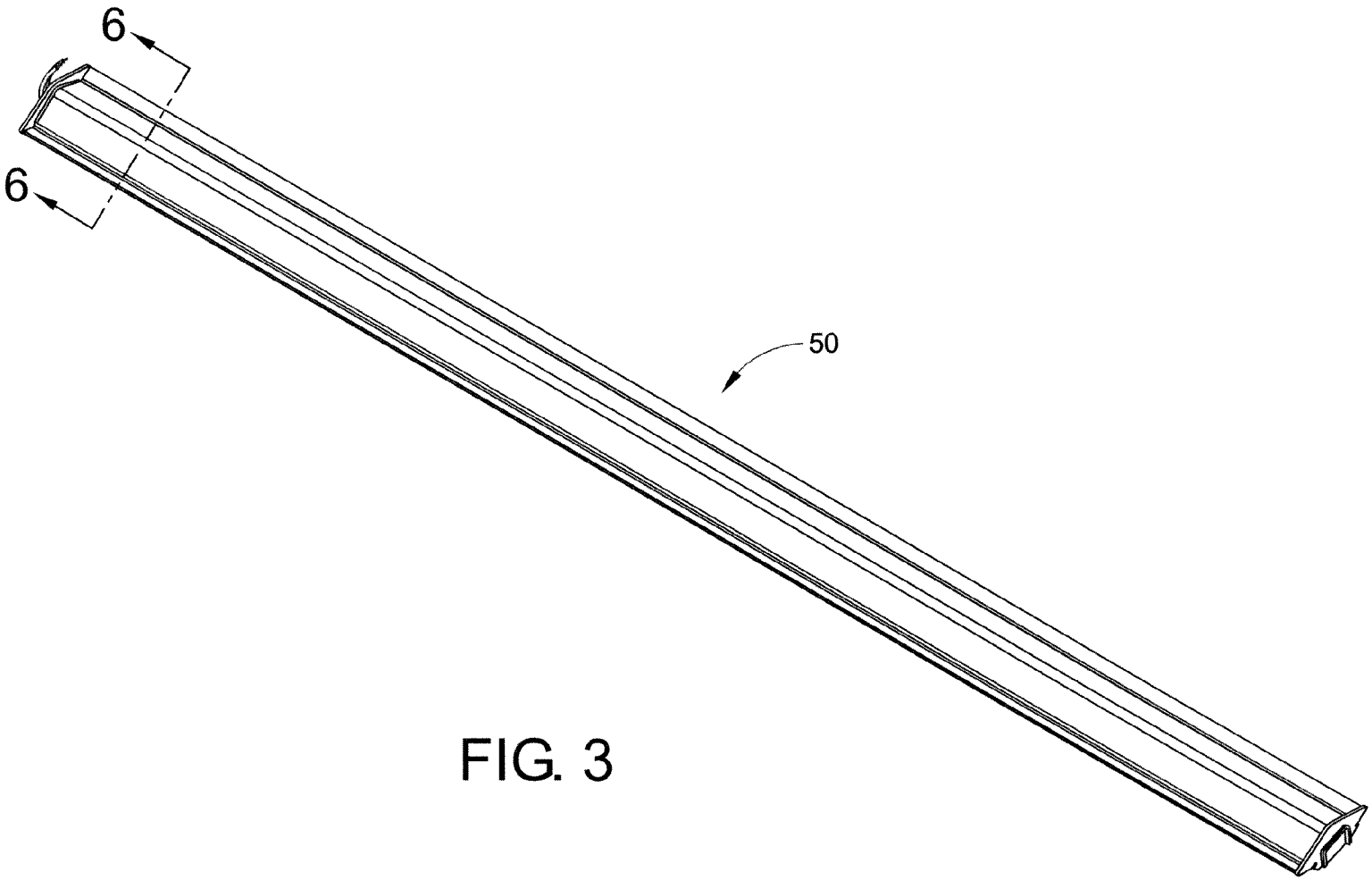
FIG. 3 is a perspective view of a lighting assembly that can mount in the refrigerated enclosure shown in FIG. 1.

With reference to FIG. 3, the lighting assembly 50 is generally elongated and paralleliped in configuration. The outer configuration of the lighting assembly 50 is similar to the lighting assembly depicted in US 2005/0265019 A1. The lighting assembly in the depicted embodiment can have a length of 24", 48", 60", 70" or another length, if desired.

Figure 4:
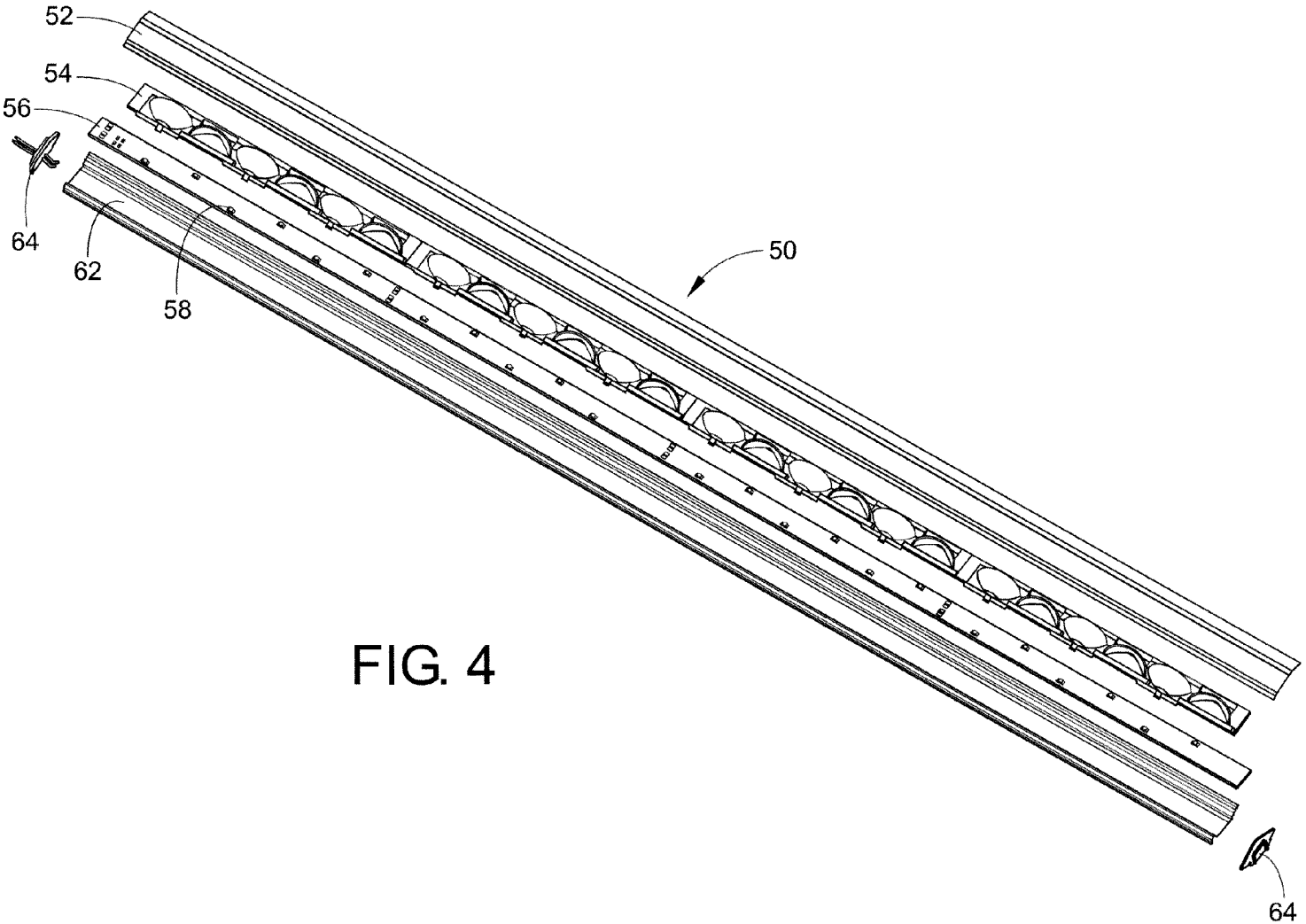
FIG. 4 is an exploded view of the lighting assembly depicted in FIG. 3.

With reference to FIG. 4, the lamp assembly 50 includes a translucent cover 52, at least one optic 54, a printed circuit board (PCB) 56, a plurality of light emitting diodes (LEDs) 58, a mounting structure 62, and end covers 64. An alternative embodiment of the design calls for a co-extruded plastic housing and lens cover. This alternative embodiment includes a plastic extruded hollow housing that has an opaque section and a clear section that acts as a lens cover. The light engine, e.g. the optic, the PCB, and the LEDs on the PCB would slip in from one end then, each end would be capped. This allows for a simple design with a hermetic seal along the length on the lens at the joint between the lens and housing. This seal would aid in self heating defog as well as IP54 and NSF/ANSI 7 certification of the product.

Figure 5:
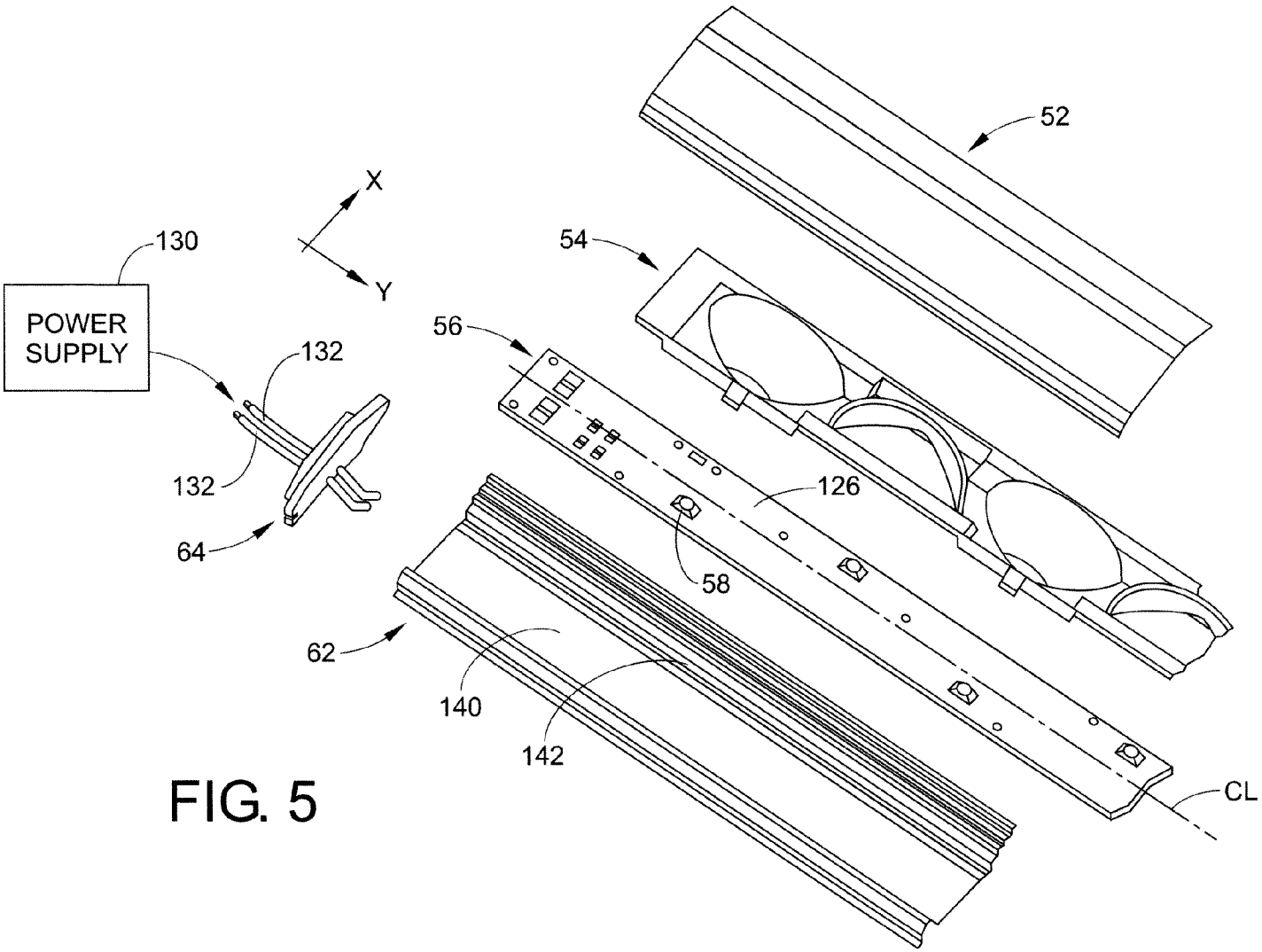
FIG. 5 is a close up view of the upper portion of the exploded assembly in FIG. 4 and a power supply depicted schematically.
Figure 6:
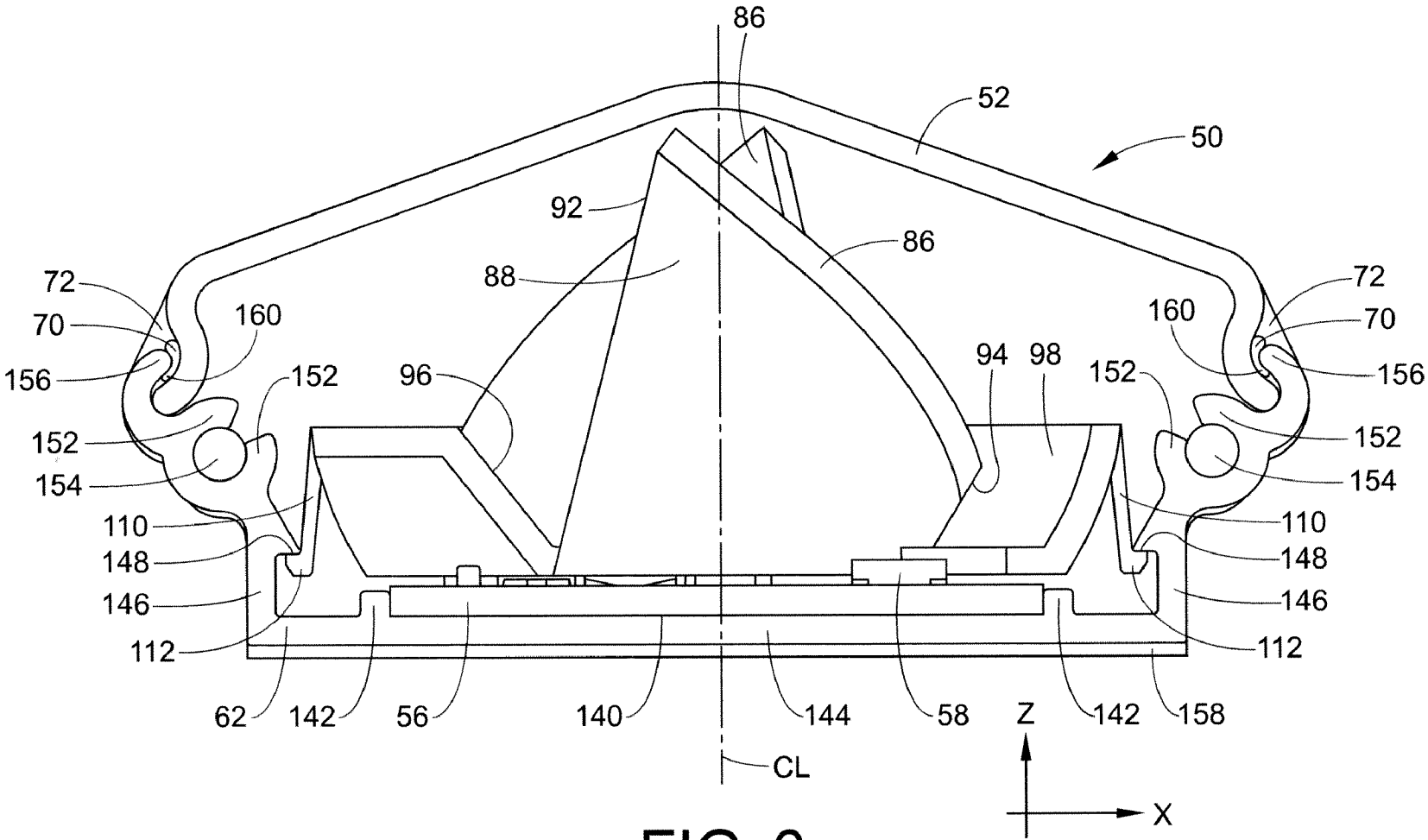
FIG. 6 is cross-sectional view of the lighting assembly depicted in FIG. 3 taken along line 6-6 in FIG. 3.

With reference back to the embodiment depicted in the Figures, with reference to FIGS. 5 and 6, the translucent cover 52 is generally V-shaped or U-shaped in cross-section (see FIG. 6). The cover is made from clear plastic, or similar material. A gasket material 70, which can be made from a soft urethane material, or the like, is fitted between the mounting structure 62 and a translucent cover 52 near each end of the cover. The connection between the mounting structure 62 and the cover 52 is to provide ingress protection from both solids and liquids. The cover 52 also includes an opaque portion 72 adjacent its longitudinal ends where it connects to the mounting structure 62. The opaque portion 72 can run the length of the translucent cover to block light so that the point light sources, for example, the LEDs 58, are not visible as a consumer walks down the aisle towards the refrigerated enclosure that includes the lighting assembly 50. The cover 52 in the depicted embodiment has no lensing properties, e.g. it is not intended to redirect light. On the other hand, the cover can also be tinted, if desired.

With reference back to FIG. 5, the optic 54 attaches to the mounting structure 62. The optic 54 is a plastic, plated reflective structure that allows performance at various throws. Some geometry of the reflective portion of the optic is truncated to allow a controlled amount of light to leak out onto secondary optics to illuminate the area of the target zone not covered by the primary optic. This optic allows the use of more common lambertian LED emitters that are readily available in warmer correlated color temperature ("CCT") color values. With reference to FIG. 4, a plurality of optics 54 are provided in each lamp assembly 50, in the example shown in FIG. 4, four (4) separate optics 54 are provided in the lamp assembly.

Figure 7:
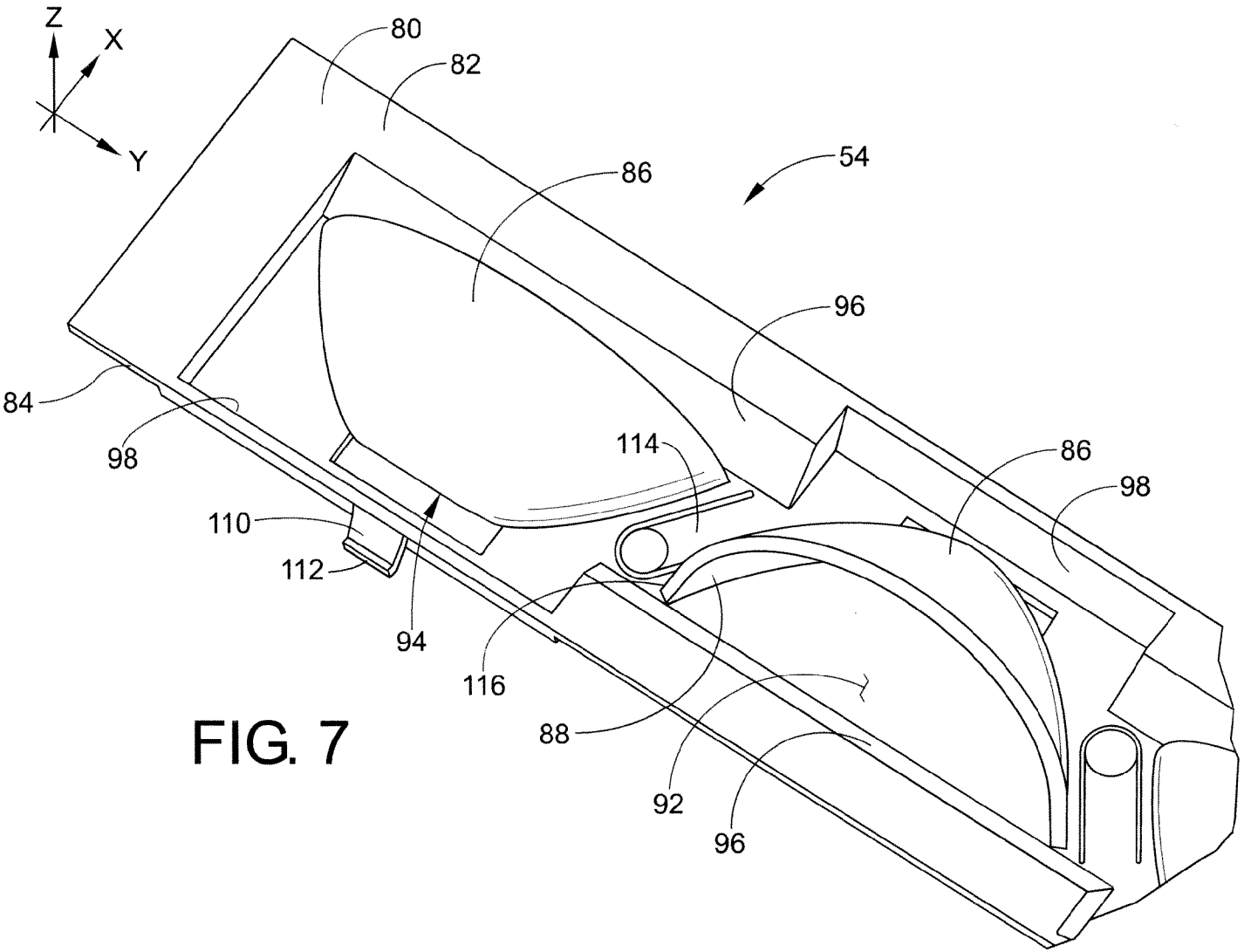
FIG. 7 is a perspective view of an upper surface of a portion an optic found in the assembly depicted in FIG. 3.

With reference to FIG. 7, each optic 54 includes a generally rectangular base 80 having an upper base surface 82 and a lower base surface 84. Reflective domes 86 extend upwardly from the upper surface 82 of the base 80. Each dome is generally half-elliptical in the y-axis, as it is shown in FIG. 7, and free form (approximately parabolic) in the x-axis, as it is shown in FIG. 7. The domes 86 can take other configurations. Each dome 86 includes an inner reflective surface 88, which can be plated, that acts a primary reflective optic surface for the lamp assembly. Each dome 86 is separated from the base 80 by a first larger opening 92 and a second smaller opening 94. The second opening 94 acts to truncate the approximate parabolic shape of the dome. The second opening 94 is generally opposite the first opening 92 (in a direction parallel to the x-axis in FIG. 7). The domes 86 are staggered in that the first, or larger, opening 92 faces in opposite directions along the y-axis. Every other reflective surface in the direction of the y-axis directs the light from a respective LED 58 in the opposite direction, which is generally aligned with the x-axis. In other words, at least one of the domes is arranged with respect to its respective LED to redirect reflecting off of the respective primary reflective surface from the respective LED in a first general direction and at least one of the domes is arranged with respect to another respective LED to direct light reflecting off of its respective primary reflective surface from the other respective LED in a second general direction that is opposite the first general direction. Staggering the domes and the LEDs minimizes space, maximizes solid angle of the light and provides a robust design. Each dome 86 is associated with a respective LED 58 (FIG. 4) to aid in the distribution of the light that is emanated from the respective LED. Further description of this will be provided below.

Figure 1:
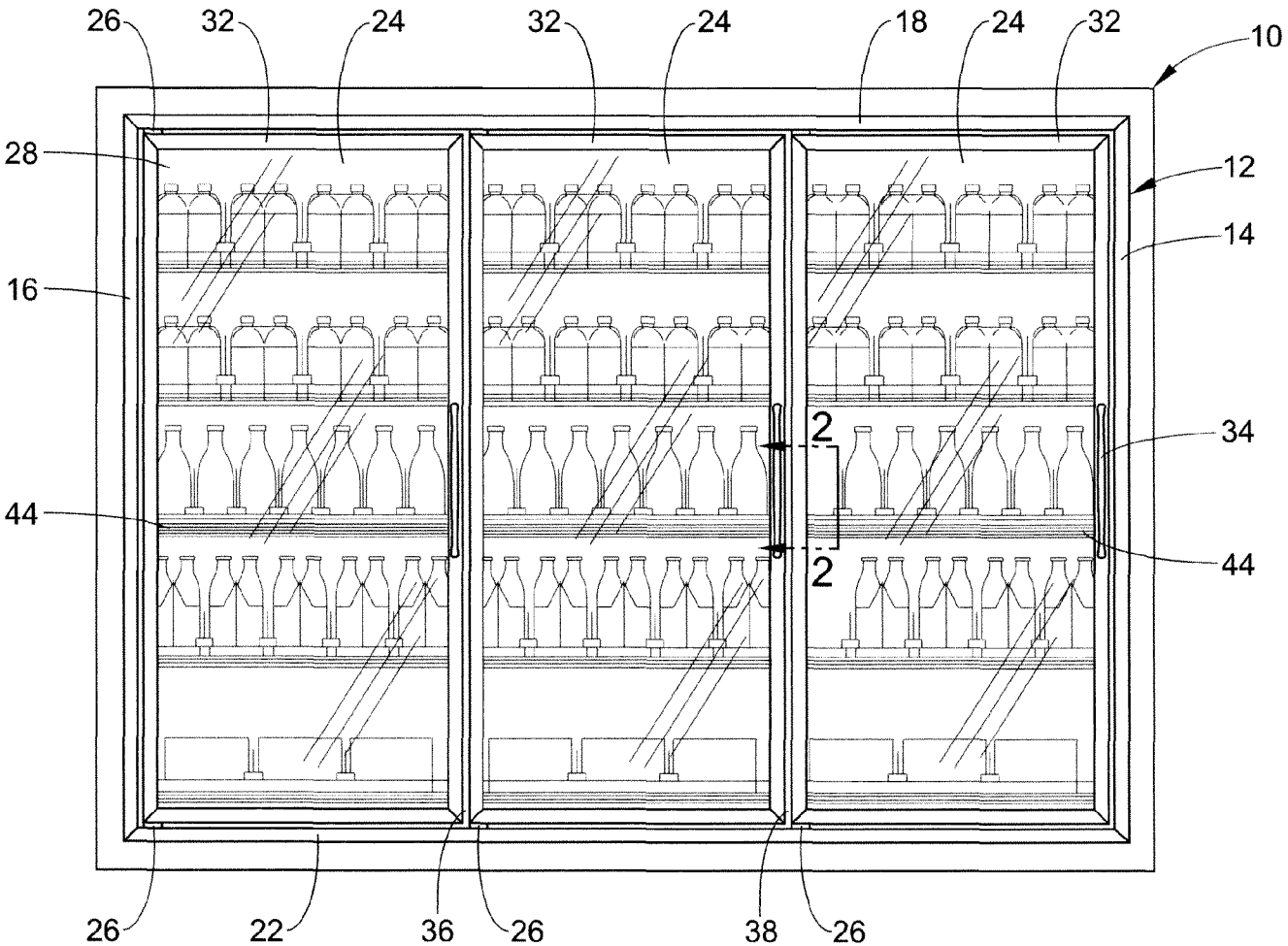
FIG. 1 is a front view of a known refrigerated enclosure.

The optic 54 also includes secondary reflective surfaces, which can also be plated. With continued reference to FIG. 7, a first secondary reflective surface 96 is disposed adjacent the larger opening 92 of the reflective dome 86. A second secondary reflective surface 98 is disposed adjacent the smaller opening 94 of the reflective dome 86. These secondary reflective surfaces 96 and 98 are nearly planar and parallel to the y-axis, but can include a slight curvature. These secondary surfaces 96 and 98 reflect light towards the area of the target plane that is generally perpendicular to the mullion when the lamp assembly is attached to a mullion such as the mullion 36 shown in FIG. 1. The secondary surfaces can also be considered as illuminating the area of the target plane that is near a line that is both perpendicular to a centerline of the light assembly and the target plane. These secondary reflective surfaces 96 and 98 also fill in lower lighted areas where it is difficult to have the inner reflective surface 88 of the dome 86 direct light in a refrigerated compartment, for example the areas near the mullion 36. These secondary reflective surfaces capture the light that leaks out and does not contact the primary reflective surface 88.

Figure 8:
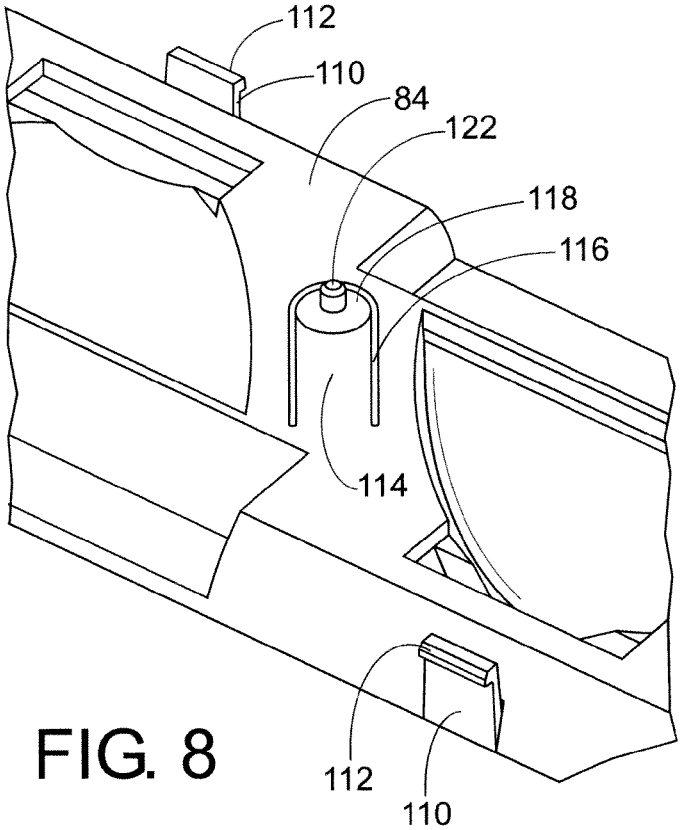
FIG. 8 is a perspective view of a lower surface a portion of the optic depicted in FIG. 7.
Figure 9:
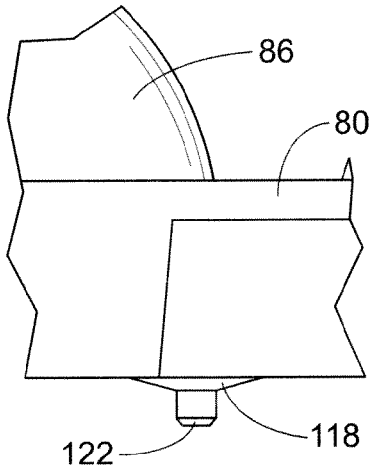
FIG. 9 is a side view of a portion the optic depicted in FIG. 7.

The optic 54 also includes an integral snap-in feature and a locating feature that allows the optic 54 to attach to the mounting structure 62 sandwiching the printed circuit board 56 between the optic and mounting structure. With reference back to FIG. 7, the optic 54 includes a plurality of flexible tabs 110 that each include a barb 112. The tabs 112 depend downwardly from the longer sides of the base 80. The tab 110 and the barb 112 allow the optic 54 to mate and innerconnect with the mounting structure 62 (see FIG. 6). A plurality of resilient pressure-applying fingers 114 are also provided on each optic 54. Each finger 114 is separated from the base 80 of the optic 54 by a cut-out 116. The finger 114 acts as a sort of leaf spring when the optic 54 is attached to the mounting structure 62. With reference to FIG. 8, each finger includes a dome-shaped downwardly extending protuberance 118 disposed at a distal end on a lower surface of each finger 114. Each finger also includes a post 122 that extends from a central axis of the protuberance 118. The protuberances 118 allow the fingers 114 to flex upwardly (in the z-axis as shown in FIG. 7) to apply a downward force on the printed circuit board 56 to retain the circuit board against the mounting structure 62. This is similar to the cams that are described in U.S. 2005/0265019. If desired, the locating feature of the mounting post 122 need not be provided. The mounting posts 122 can fit into openings 126 provided in the PCB 56 to act as a locating feature for the optic with respect to the PCB.

The PCB 56 depicted in the figures is an FR4 two-sided printed circuit board with thermal vias. Circuitry is provided on the PCB in a manner that is known in the art. Alternatively, the PCB can be made from other materials, such as a metal clad or a metal core PCB.

The LEDs 58 are staggered on opposite sides of a central axis (parallel to the y-axis in FIG. 5) of the PCB 56 moving along the PCB in the direction parallel with the y-axis. This allows for more LEDs per inch of the PCB which corresponds to a higher lumen output as compared to if the LEDs were not staggered on the PCB. The circuitry on the PCB connects the LEDs in a parallel/series configuration.

The LEDs 58 are standard Lambertian-type LED devices that are available from a number of different LED manufacturers such as Nichia, Cree, Osram and Philips Lumileds. The LEDs 58 are driven by an external power supply 130 that is in electrical communication with wires 132 that extend through one of the end caps 64. The wires 132 connect to the circuitry of the PCB 56 in a known manner to power the LEDs 58. The power supply 130 will be described in more detail below.

The PCB 56 is held against the mounting structure 62 by the optic 54. The mounting structure 62 in the depicted embodiment is an extruded aluminum member, which allows the mounting structure to operate as a heat sink. The PCB 56 is held in a channel 140 formed in the mounting structure. With reference to FIG. 6, the mounting structure 62 includes two longitudinal ridges 142 that extend upwardly (in the z-axis) from a base 144 and run parallel to the y-axis along the entire length of the mounting structure. The ridges 142 are spaced from one another in the x-axis a distance that is about equal to the width of the PCB 56 (as measured in the x-axis) to define the channel 140.

The mounting structure 62 also includes two outer upwardly extending outer side walls 146 that run parallel to the y-axis along the entire length of the mounting structure. The side walls 146 include inwardly protruding ledges 148 that provide a catch surface for the resilient tabs 110 and barbs 112 of the optic 54. The side walls 146 also include curved inwardly protruding extensions 152 that generally define a circular opening 154 that is to receive fasteners (not depicted) to attach the end plates 64 (FIG. 4) to the mounting structure 62. The side walls 146 also include a distal curved portion 156 that defines a channel 160 that receives the distal portion of the cover 52. The side wall extends above the LED 58 in the z-axis enough that the consumer does not view the LED as a plurality of point light sources when viewing the contents that are stored in the enclosure (for example the enclosure depicted in FIG. 1). A thermal isolation barrier 158 attached between the mounting structure 62 (heat sink) and the refrigerator case mullion 36 helps defog the assembly and does not allow a thermal path to the outside of the refrigerator case.

Figure 10:
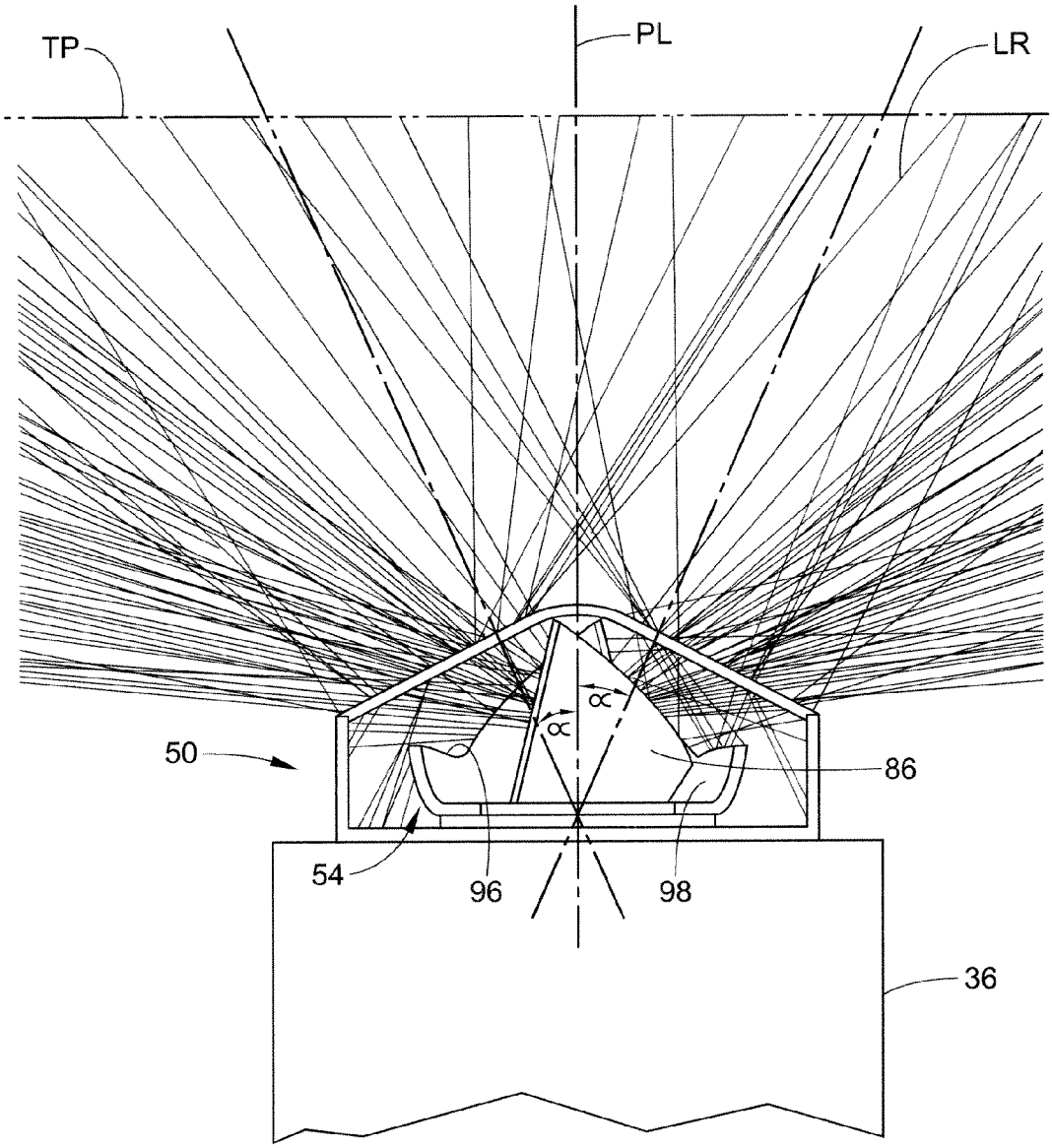
FIG. 10 is a schematic depiction of light rays reflecting off surfaces of the optic and traveling towards a target plane for the lighting assembly depicted in FIG. 3.
Figure 11:
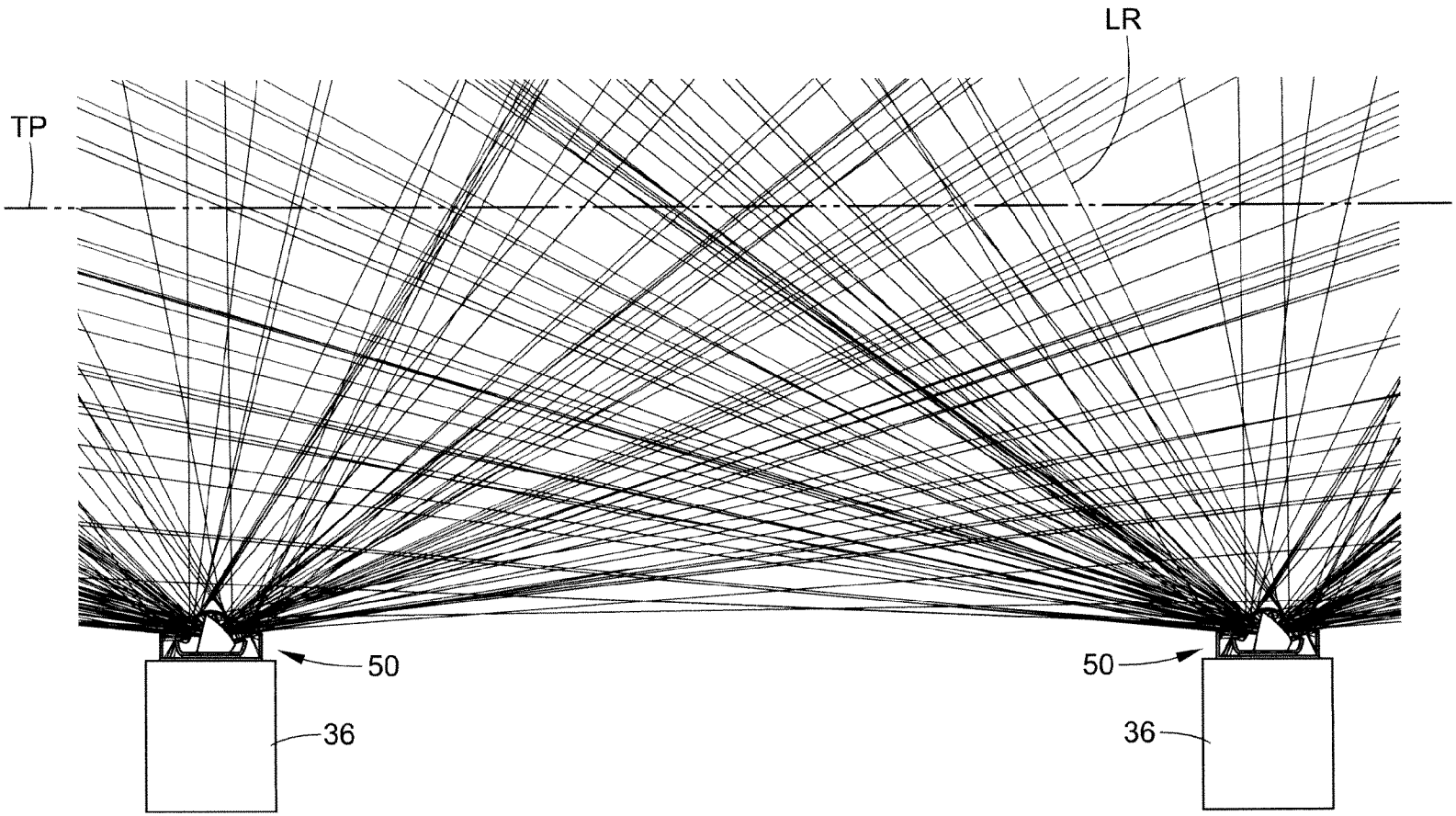
FIG. 11 is a schematic representation similar to FIG. 12 showing light rays emanating from two adjacent lighting assemblies directing light towards a target plane.

With reference to FIG. 10, the optic 54 is useful to distribute light along a target plane, which is typically defined by the location of the front a the shelf in a commercial refrigeration application. FIGS. 10 and 11 both depict schematic views (viewed from the top of the refrigerated enclosure shown in FIG. 1) of light rays LR emanating from the light assembly 50 attached to a mullion 36. The location of the target plane TP can vary (compare FIG. 10 to FIG. 11).

With reference back to FIG. 6, the primary reflective surface 88 directs light from the LED 58, which is located on one side of the centerline of the lamp assembly 50, towards the opposite side of the centerline of the lamp assembly. Each dome 86 associated with LEDs 58 on one side of the centerline directs light from the LED towards the other side of the centerline. Moreover, the primary reflective surface directs light away from the area of the target plane that is directly in front of, i.e. generally perpendicular to, the mullion 36 (see FIGS. 10 and 11). The area of the target plane that is generally perpendicular to the mullion refers to an area having bounded by a small acute inside angle $\alpha$ (e.g. less than about 30 degrees, and more preferably less than about 20 degrees) from a line PL that is perpendicular to the mullion and the target plane. In view of this, the secondary reflective surfaces 96 and 98 are the surfaces that direct light towards the area of the target place that is directly or nearly directly in front of the mullion 36.

Figure 12:
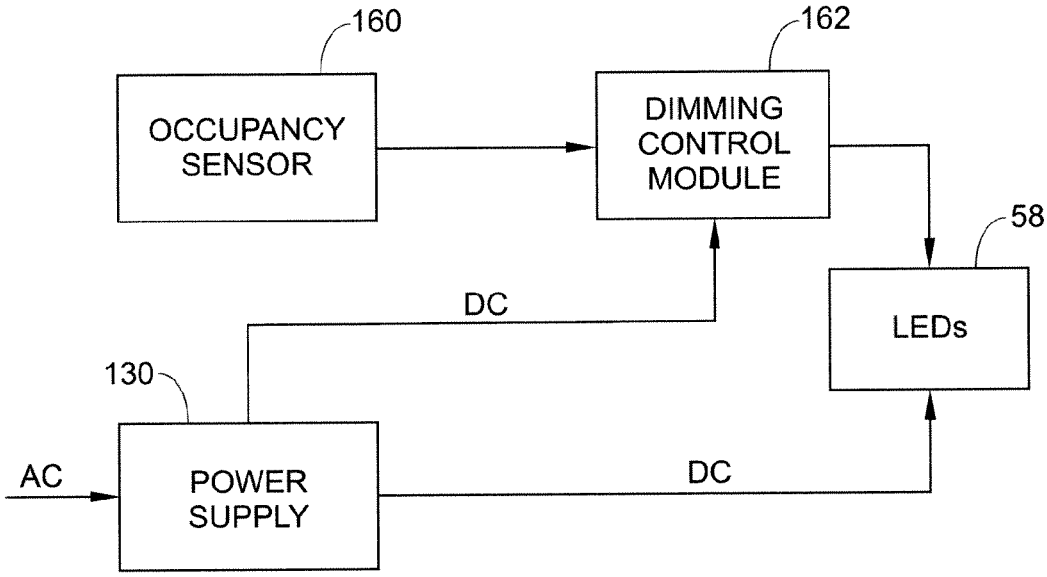
FIG. 12 is a schematic view of an electrical configuration for use with the lighting assembly depicted in FIG. 3.

With reference to FIG. 12, the lamp assembly 50 can communicate with an occupancy sensor 160 and a dimming control module ("DCM") 162 to allow the lamp assembly to dim the LEDs 58. In the depicted example, the occupancy sensor 160 can be a known type occupancy sensor that uses an ultrasonic sensor or a sensor that uses a timing circuit. The occupancy sensor in the depicted embodiment provides a contact closure. The occupancy sensor 160 communicates a signal (on/off) to the DCM 162. The DCM receives power, which in the depicted electrical schematic is DC voltage, from the power supply 130 and delivers a signal to the LEDs based on the signal received from the occupancy sensor. The power supply is also delivering power to the LEDs. Where the occupancy sensor 160 detects the presence (on) or absence (off) of a person, when "on" the DCM delivers a first signal to the LEDs 58 so that the LEDs illuminate at a first power. When the occupancy sensor does not detect a person, the DCM delivers a second signal to the LEDs, thus conserving energy. The signal can be a pulse width modulation signal where the duty cycle is a function of the signal received from the occupancy sensor. The signal can be a pulse frequency modulation where the frequency is varied based on the signal received from the occupancy sensor. Also, the signal can be a pulse amplitude modulation where the amplitude is varied based on the signal received from the occupancy sensor.

An LED lamp has been described. Modifications and alterations will occur to those upon reading and understanding the preceding detailed description. The invention is not limited to only the embodiments disclosed above. Instead, the invention is broadly defined by the appended claims and the equivalents thereof.

The invention claimed is:

1. An LED lamp comprising:

a plurality of LEDs spaced along an axis of the lamp; and, at least one reflector associated with the LEDs, the at least one reflector including a plurality of domes extending away from a base and each being separated from the base by at least one opening including a first opening and a second opening generally opposite the first opening, each dome including an inner primary reflective surface associated with a corresponding LED, wherein at least one of the domes is arranged with respect to a respective first LED to redirect light reflecting off of the respective primary reflective surface from the respective first LED in a first general direction and at least one of the domes is arranged with respect to another respective second LED to direct light reflecting off of the respective primary reflective surface from the another respective second LED in a second general direction that is opposite the first general direction, wherein a majority of the light produced by the first respective LED is directed in the first general direction and a majority of the light produced by the second respective LED is directed in the second general direction.

2. The lamp of claim 1, wherein the domes are staggered and face in opposite directions along the axis of the lamp.

3. The lamp of claim 2, wherein the LEDs are staggered on opposite sides of the axis of the lamp.

4. The lamp of claim 3, wherein each dome associated with LEDs on one side of the axis directs light from the respective LED towards the opposite side of the axis.

5. The lamp of claim 1, wherein said second opening creates a truncated portion of said dome.

6. The lamp of claim 5, wherein the at least one reflector includes a secondary reflective surface disposed adjacent the second opening, wherein at least a portion of light passing through said truncated portion is reflected by said secondary reflective surface.

7. The lamp of claim 6, wherein the at least one reflector includes an additional secondary reflective surface disposed adjacent the first opening, the additional secondary reflective surface being positioned with respect to the corresponding LED and the dome to reflect direct light from the LED towards a target plane.

8. The lamp of claim 5, wherein the first opening is smaller than the second opening.

9. The lamp of the claim 1 wherein said dome is a partial dome.

10. The lamp of claim 1 wherein said LEDs are mounted to a printed circuit board.

11. The lamp of claim 1 wherein said dome is substantially half elliptical.

12. The lamp of claim 5 wherein said first opening and said second truncated opening of adjacent domes are directed in a generally staggered orientation.

13. The lamp of claim 1 wherein a portion of the light exiting the lamp is not reflected light.

14. The lamp of claim 1 being mounted to a mullion of a display case.

15. The lamp of claim 1 wherein said dome optic includes a plurality of projections for snap mating to a substrate.

* * * * *